US010737502B2

(12) United States Patent
Goto et al.

(10) Patent No.: US 10,737,502 B2
(45) Date of Patent: Aug. 11, 2020

(54) FLUID CIRCULATION APPARATUS AND FLUID EJECTION APPARATUS

(71) Applicant: TOSHIBA TEC KABUSHIKI KAISHA, Tokyo (JP)

(72) Inventors: Taiki Goto, Mishima Shizuoka (JP); Kazuhiro Hara, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/104,735

(22) Filed: Aug. 17, 2018

(65) Prior Publication Data

US 2019/0092034 A1 Mar. 28, 2019

(30) Foreign Application Priority Data

Sep. 25, 2017 (JP) ..... 2017-183714

(51) Int. Cl.
*B41J 2/175* (2006.01)
*B41J 2/18* (2006.01)
*B41J 29/38* (2006.01)

(52) U.S. Cl.
CPC ..... *B41J 2/17566* (2013.01); *B41J 2/175* (2013.01); *B41J 2/17596* (2013.01); *B41J 2/18* (2013.01); *B41J 29/38* (2013.01); *B41J 2002/17576* (2013.01)

(58) Field of Classification Search
CPC . B41J 2/175; B41J 2/18; B41J 2/17596; B41J 29/38; B41J 2/17513; B41J 2/17566; B41J 2202/12; B41J 29/393; B41J 2002/17576
See application file for complete search history.

(56) References Cited

U.S. PATENT DOCUMENTS 8,567,895 B2 10/2013 Furukawa et al.
8,602,512 B2 12/2013 Furukawa et al.
9,694,595 B2 7/2017 Ohtsu et al.
2007/0291086 A1* 12/2007 Murakami ..... B41J 2/18 347/85
2010/0085396 A1* 4/2010 Yokota ..... B41J 2/18 347/17
(Continued)

FOREIGN PATENT DOCUMENTS

EP 2468512 A1 6/2012
EP 3147124 A1 3/2017
(Continued)

OTHER PUBLICATIONS

Extended European Search Report dated Feb. 5, 2019, mailed in counterpart European Application No. 18194040.4, 11 pages.
U.S. Appl. No. 16/104,768, filed Aug. 17, 2018.

*Primary Examiner* — Jannelle M Lebron
(74) *Attorney, Agent, or Firm* — Kim & Stewart LLP

(57) ABSTRACT

According to one embodiment, a fluid circulation apparatus includes a first tank to store fluid to be supplied to a fluid ejection head, a circulation path including a first flow path portion to provide fluid from the first tank to a supply port of the fluid ejection head, and a second flow path portion to return fluid from a collection port of the fluid ejection head to the first tank, a bypass flow path to connect the supply port to the collection port outside of the fluid ejection head, and a pressure sensor configured to measure pressure of the bypass flow path.

14 Claims, 9 Drawing Sheets

(56) References Cited

U.S. PATENT DOCUMENTS

| | | | |
|---|---|---|---|
| 2012/0162331 | A1 | 6/2012 | Kataoka et al. |
| 2017/0043589 | A1 | 2/2017 | Ratjen et al. |
| 2017/0197417 | A1 | 7/2017 | Karita et al. |
| 2018/0072069 | A1 | 3/2018 | Hara et al. |

FOREIGN PATENT DOCUMENTS

| | | | |
|---|---|---|---|
| JP | 2852269 | B2 | 1/1999 |
| JP | 2001-219581 | A | 8/2001 |
| JP | 2016-221817 | A | 12/2016 |

* cited by examiner

FLUID CIRCULATION APPARATUS AND FLUID EJECTION APPARATUS

CROSS-REFERENCE TO RELATED APPLICATION

This application is based upon and claims the benefit of priority from Japanese Patent Application No. 2017-183714, filed Sep. 25, 2017, the entire contents of which are incorporated herein by reference.

FIELD

Embodiments described herein relate generally to a fluid circulation apparatus and a fluid ejection apparatus.

BACKGROUND

A fluid circulation apparatus for circulating fluid through a fluid ejection head in a circulation path is known. The fluid ejection apparatus includes pressure sensors respectively upstream and downstream of the fluid ejection head of the circulation path. In such a fluid ejection apparatus, the pressure of a nozzle is calculated from the pressure values measured by the pressure sensors.

DETAILED DESCRIPTION

In general, according to one embodiment, a fluid circulation apparatus includes a first tank to store fluid to be supplied to a fluid ejection head, a circulation path including a first flow path portion to provide fluid from the first tank to a supply port of the fluid ejection head, and a second flow path portion to return fluid from a collection port of the fluid ejection head to the first tank, a bypass flow path to connect the supply port to the collection port outside of the fluid ejection head, and a pressure sensor configured to measure pressure of the bypass flow path.

Figure 1:
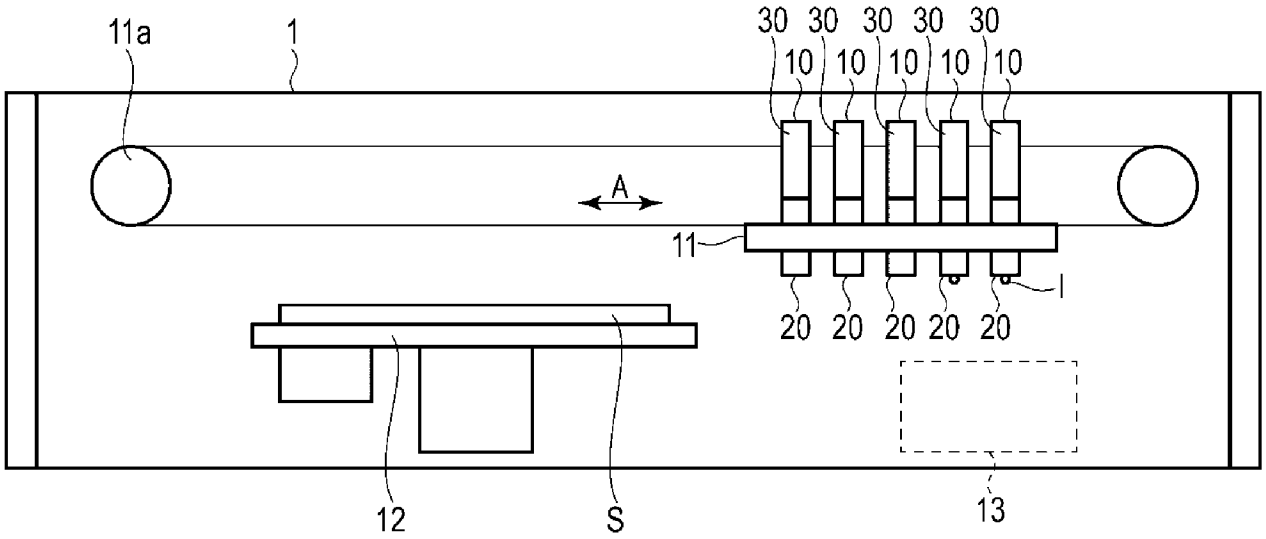
FIG. 1 is a side view of an inkjet recording apparatus according to a first embodiment.
Figure 2:
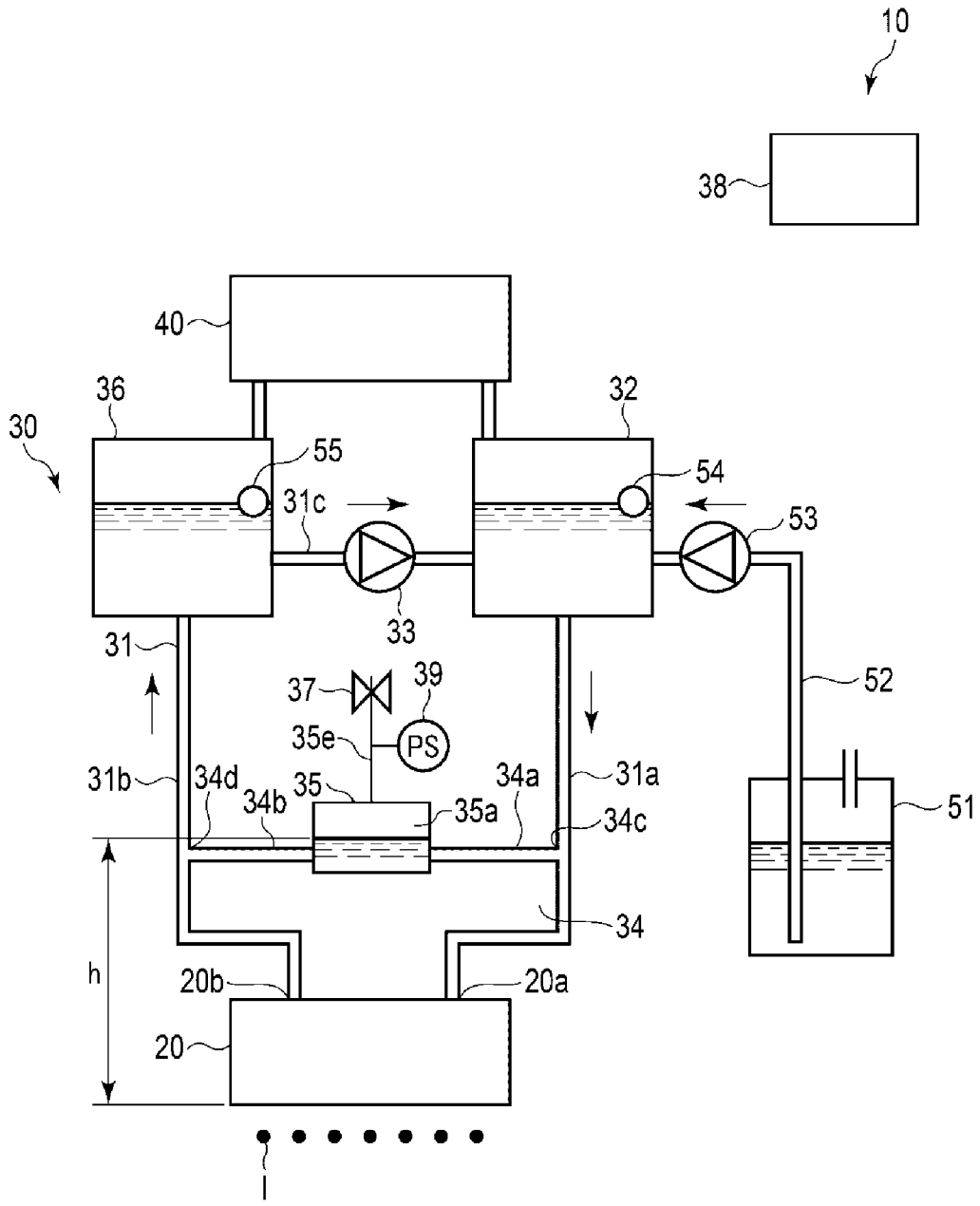
FIG. 2 is an explanatory view of a fluid ejection apparatus according to the first embodiment.
Figure 3:
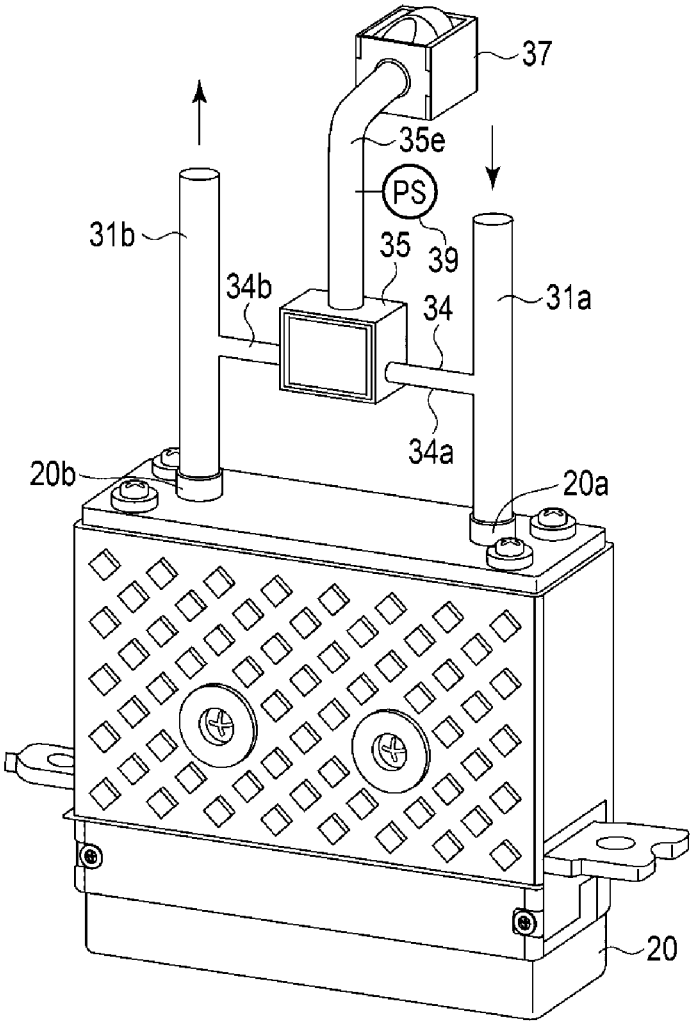
FIG. 3 is a partial perspective view of the fluid ejection apparatus.
Figure 4:
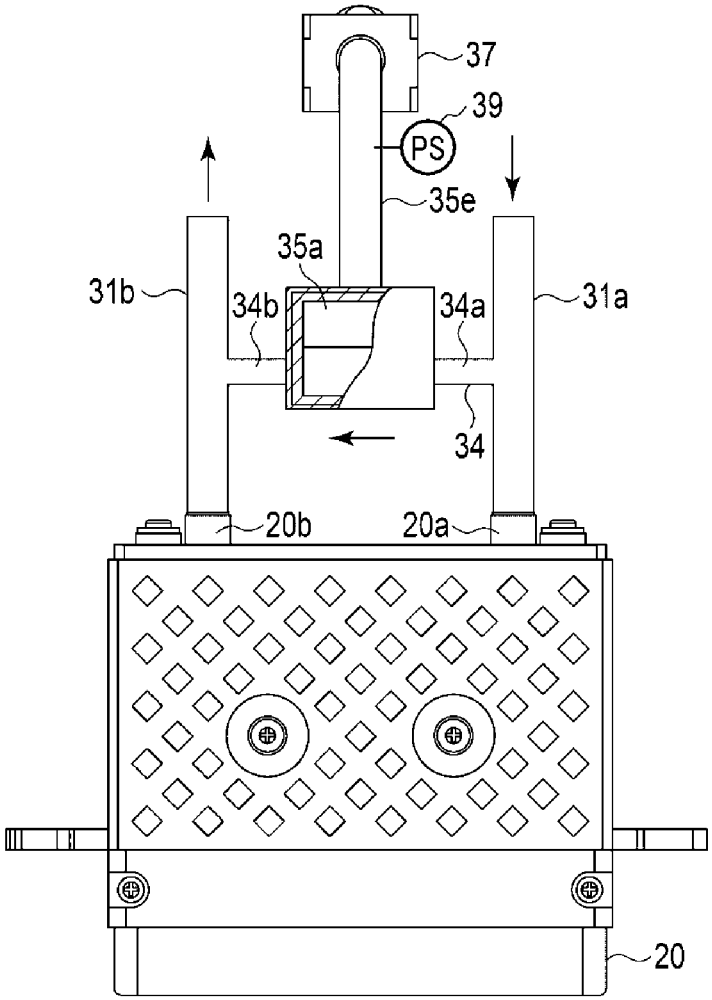
FIG. 4 is a partial front view of the fluid ejection apparatus.
Figure 5:
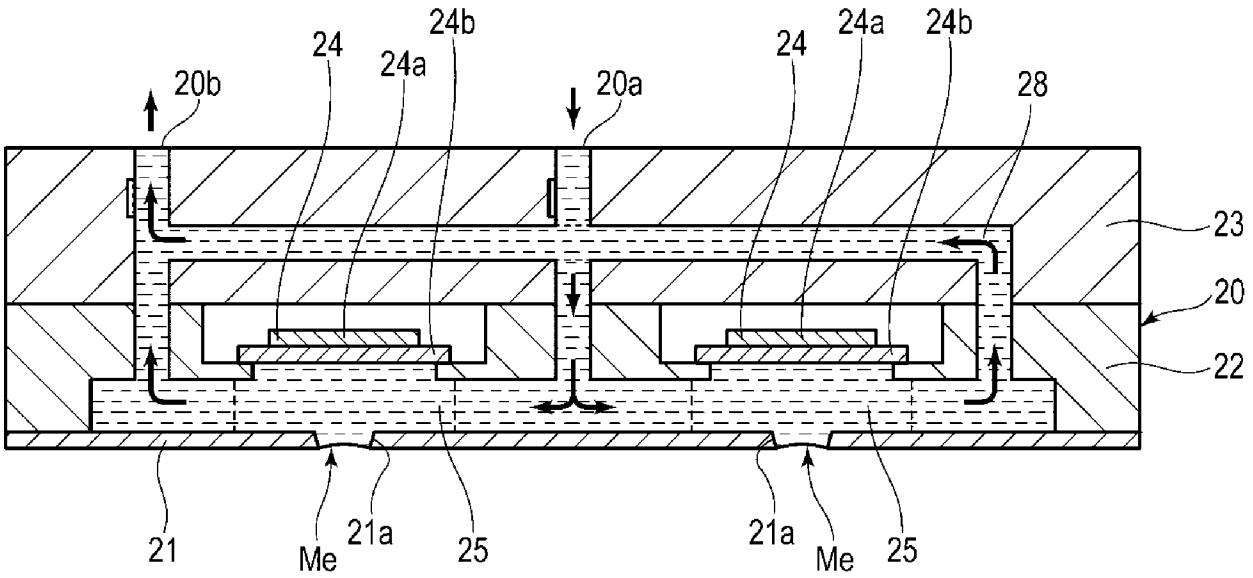
FIG. 5 is an explanatory view of a fluid ejection head of the fluid ejection apparatus.
Figure 6:
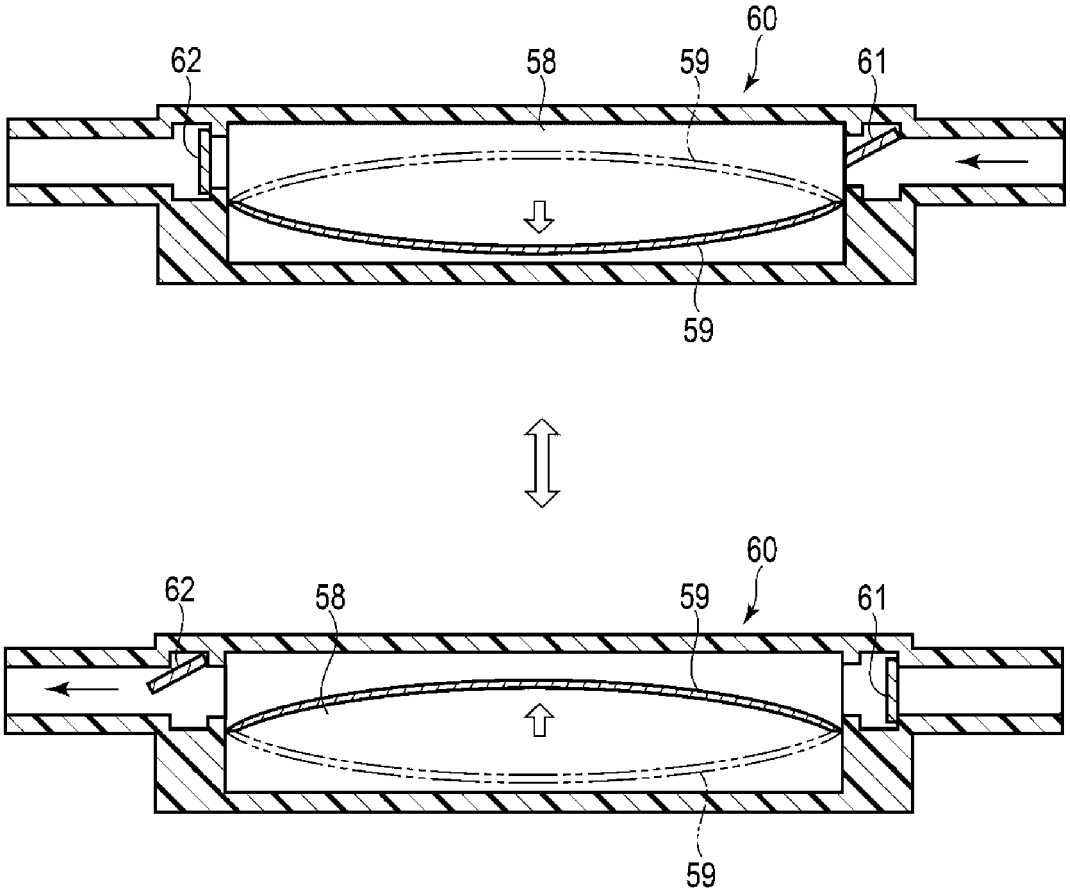
FIG. 6 is an explanatory view of a piezoelectric pump of the fluid ejection apparatus.
Figure 7:
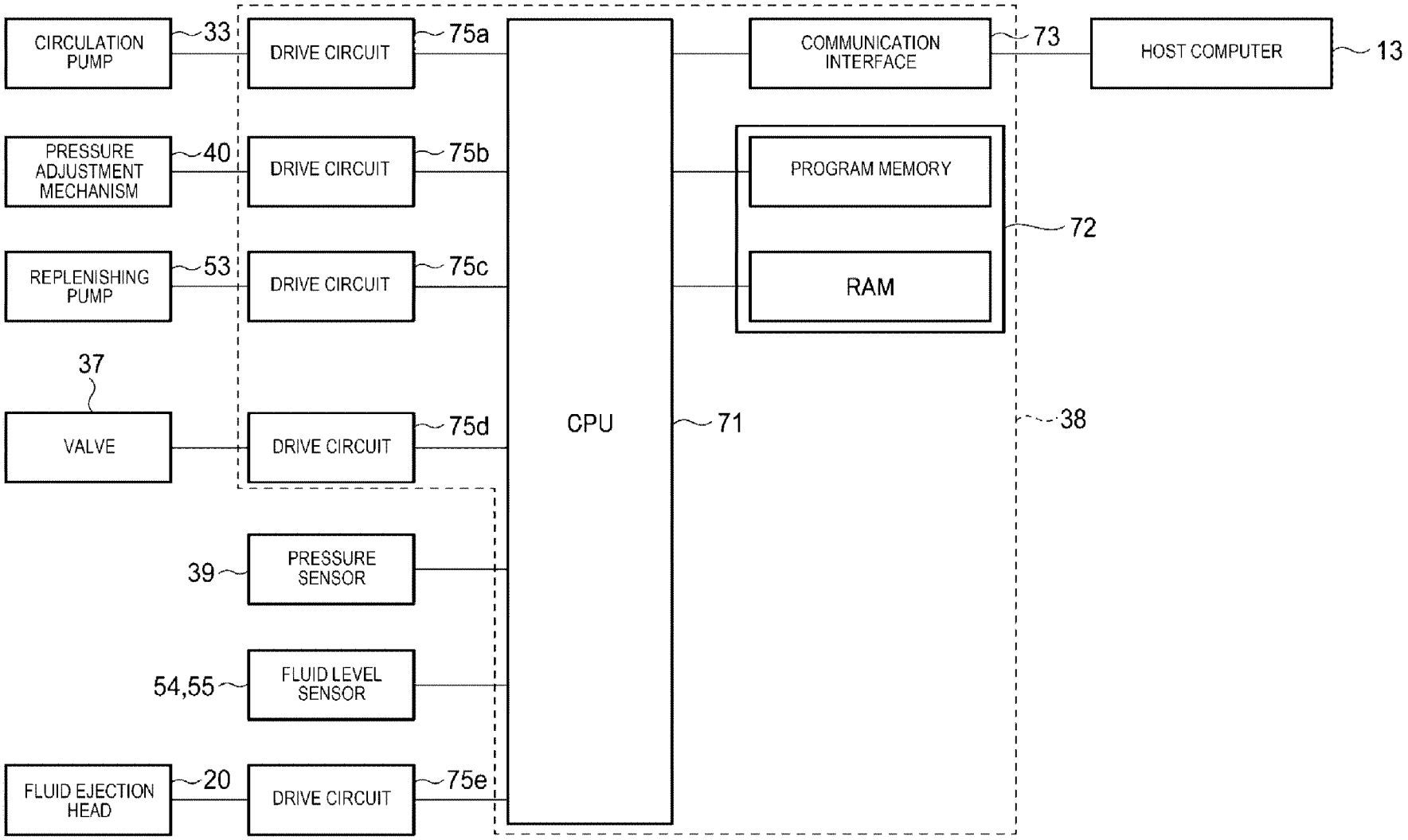
FIG. 7 is a block diagram of a control unit of the fluid ejection apparatus.

Hereinafter, an inkjet recording apparatus 1 and a fluid ejection apparatus 10 according to a first embodiment will be described with reference to FIGS. 1 to 7. It should be noted that the drawings are schematic and are drawn with exaggeration and omissions for purposes of explanatory convenience. In general, components are not drawn to scale. In addition, the number of components, the dimensional ratio between different components, or the like, does not necessarily match between different drawings or to actual devices. FIG. 1 is a side view of the inkjet recording apparatus 1. FIG. 2 is an explanatory view of the fluid ejection apparatus 10. FIGS. 3 and 4 are a partial perspective view and a partial front view of the configuration of the fluid ejection apparatus 10, respectively. FIG. 5 is an explanatory view of a fluid ejection head 20. FIG. 6 is an explanatory view of a circulation pump 33 and a replenishing pump 53. FIG. 7 is a block diagram of the fluid ejection apparatus 10.

The inkjet recording apparatus 1 shown in FIG. 1 includes a plurality of fluid ejection apparatuses 10, a head support mechanism 11 for movably supporting the fluid ejection apparatus 10, a medium support mechanism 12 for movably supporting a recording medium S, and a host control device 13.

As shown in FIG. 1, the plurality of fluid ejection apparatuses 10 is arranged in parallel in a predetermined direction and supported by the head support mechanism 11. The fluid ejection apparatus 10 integrally includes a fluid ejection head 20 and a circulation device 30. The fluid ejection apparatus 10 ejects, for example, an ink I from the fluid ejection head 20 as fluid, thereby forming a desired image on the recording mediums S arranged opposite to each other.

The plurality of fluid ejection apparatuses 10 ejects multiple colors such as a cyan ink, a magenta ink, a yellow ink, a black ink, and a white ink, respectively, but the color or characteristic of the ink I to be used is not limited. For example, in place of a white ink, a transparent glossy ink, a specialty ink that develops a color when irradiated with infrared rays or ultraviolet rays, or the like may be ejected. The plurality of fluid ejection apparatuses 10 have the same configuration although fluid to be ejected is different.

The fluid ejection head 20 shown in FIGS. 3 to 5 is an inkjet head and includes a nozzle plate 21 having a plurality of nozzles 21*a*, a substrate 22, and a manifold 23 joined to the substrate 22. The substrate 22 is joined so as to face the nozzle plate 21 and is formed in a predetermined shape to form a fluid flow path 28 including a plurality of fluid pressure chambers 25 between the substrate 22 and the nozzle plate 21. An actuator 24 is provided on a portion of the substrate 22 facing each fluid pressure chamber 25. The substrate 22 has partition walls arranged between adjacent fluid pressure chambers 25 in the same row. The actuator 24 is disposed to face a nozzle 21*a*, and the fluid pressure chamber 25 is formed between the actuator 24 and the nozzle 21*a*.

The fluid ejection head 20 includes the fluid pressure chamber 25 therein by the nozzle plate 21, the substrate 22, and the manifold 23 in the fluid flow path 28. The actuator 24 having electrodes 24*a* and 24*b* is provided at a portion facing the fluid pressure chamber 25 of the substrate 22. The actuator 24 is connected to a drive circuit. In the fluid ejection head 20, the actuator 24 deforms according to the voltage under the control of a module control unit 38 (depicted in FIG. 2), thereby causing fluid to be ejected from the opposing nozzle 21*a*.

As shown in FIGS. 2 to 4, the circulation device 30 is integrally connected to the upper part of the fluid ejection head 20 by metal connecting parts. The circulation device 30 includes a circulation path 31 configured to circulate fluid through the fluid ejection head 20, an upstream tank 32 (also referred to as a first tank) provided in the circulation path 31, a circulation pump 33 (referred to as a first pump), a bypass flow path 34, a bypass tank 35, an opening/closing valve 37, and a module control unit 38 that controls a fluid ejection operation.

The circulation device 30 includes a cartridge 51, functioning as a supply tank provided outside the circulation path 31, a supply path 52, and a replenishing pump 53 (referred to as a second pump). The cartridge 51 is configured to hold the fluid to be supplied to the upstream tank 32, and the internal air chamber of the cartridge 51 is open to the atmosphere. The supply path 52 is a flow path connecting the upstream tank 32 and the cartridge 51. The replenishing pump 53 is provided in the supply path 52 and delivers the fluid from the cartridge 51 to the upstream tank 32.

The circulation path 31 includes a first flow path 31*a* extending from the upstream tank 32 to a supply port 20*a* (of the fluid ejection head 20), a second flow path 31*b* extending from a collection port 20*b* (of the fluid ejection head 20) to a downstream tank 36, a third flow path 31*c* extending from the downstream tank 36 to the upstream tank.

The upstream tank 32 is connected to the primary side of the fluid ejection head 20 by the circulation path 31 and is configured to store fluid. In the upstream tank 32, a fluid level sensor 54 is provided to detect a fluid level in the upstream tank 32.

The downstream tank 36 is connected to the secondary side of the fluid ejection head 20 by the circulation path 31 and is configured to store fluid. In the downstream tank 36, a fluid level sensor 55 is provided to detect a fluid level in the downstream tank 36 is provided.

The upstream tank 32 and the downstream tank 36 are connected to a pressure adjustment mechanism 40.

The pressure adjustment mechanism 40 includes an opening/closing mechanism that opens and closes the air chambers of the upstream tank 32 and the downstream tank 36 with respect to the atmosphere, and an adjustment mechanism that pressurizes and depressurizes the upstream tank 32 and the downstream tank 36. Under the control of a CPU 71 (depicted in FIG. 7), the pressure adjustment mechanism 40 adjusts the pressure of the circulation path 31 by opening the upstream tank 32 and the downstream tank 36 to the atmosphere and pressurizing and depressurizing the downstream tank 36 to adjust the fluid pressure of the nozzle 21*a*.

In the third flow path 31*c*, the circulation pump 33 is provided to supply fluid to the upstream tank 32 from the downstream tank 36.

The bypass flow path 34 is a flow path that connects the first flow path 31*a* and the second flow path 31*b*. The bypass flow path 34 connects the primary side of the fluid ejection head 20 and the secondary side of the fluid ejection head 20 in the circulation path 31 in a short circuiting manner (that is, without passing through the fluid ejection head 20). The bypass tank 35 is connected to the bypass flow path 34. That is, the bypass flow path 34 includes a first bypass flow path 34*a* connecting the bypass tank 35 and the first flow path 31*a* and a second bypass flow path 34*b* connecting the bypass tank 35 and the second flow path 31*b*.

In the bypass tank 35, a pressure sensor 39 is provided to measure the pressure in the air chamber of the bypass tank 35.

The first bypass flow path 34*a* and the second bypass flow path 34*b* may have the same length. In the first embodiment, the bypass tank 35 is provided at a midpoint of the bypass flow path 34, and the first bypass flow path 34*a* and the second bypass flow path 34*b* have the same pipe length and pipe diameter.

In the circulation path 31, the distance from a branch point 34*c*, at which the bypass flow path 34 branches from the first flow path 31*a*, to the supply port 20*a* is the same as the distance from the collection port 20*b* to the junction point 34*d*, at which the second bypass flow path 34*b* joins the second flow path 31*b*.

In the first embodiment, the bypass flow path 34 has a smaller diameter than the circulation path 31 so that the flow path resistance on the bypass flow path 34 side is 2 to 5 times the flow path resistance on the fluid ejection head 20 side. For example, the first bypass flow path 34*a* and the second bypass flow path 34*b* have the same length and the same diameter, both of which have a smaller diameter than the circulation path 31. For example, in the first embodiment, the diameter of the circulation path 31 is set to about 2 to 5 times the diameter of the first bypass flow path 34*a* or the second bypass flow path 34*b*. As an example, the flow path diameter of the bypass flow path 34 is set to 0.7 mm or less, and the flow path diameter of the circulation path 31 is set to about 2.0 mm. The first bypass flow path 34*a* and the second bypass flow path 34*b* are each configured to have a length of about 2 mm.

The pressure in the circulation path 31 is such that the primary side of the fluid ejection head 20 (that is, the inflow side) is at a higher pressure than the secondary side of the fluid ejection head 20 (that is, the outflow side) due to the pressure drop due to the flow resistance of the fluid ejection head 20. Therefore, in the circulation path 31 and the bypass flow path 34 passing through the fluid ejection head 20, fluid flows from the high-pressure primary side to the low-pressure secondary side, as indicated by arrows in FIG. 2.

The bypass tank 35 has a flow path cross-sectional area larger than the cross-sectional area of the flow path of the bypass flow path 34 and is configured to store fluid. The bypass tank 35 has, for example, an upper wall, a lower wall, a rear wall, a front wall, and a pair of right and left side walls and is configured to have a rectangular box shape forming an accommodating chamber 35*a* for storing fluid therein. The bypass flow path 34 is connected to a pair of side walls of the bypass tank 35, respectively. In the first embodiment, for example, the connection position of the first bypass flow path 34*a* on the inflow side to the bypass tank 35 and the connection position of the second bypass flow path 34*b* on the outflow side to the bypass tank 35 are set to the same height.

The bypass tank 35 has a flow path cross-sectional area 200 times to 300 times the flow path cross-sectional area of the bypass flow path 34. For example, the bypass tank 35 is configured such that the dimensions in a height direction and a depth direction, which are two directions orthogonal to the bypass flow path 34, are 10 mm, respectively and the dimension in a width direction parallel to the bypass flow path 34 is about 20 mm.

In the bypass tank 35, the fluid flowing through the bypass flow path 34 is disposed in the lower region of an accommodating chamber 35*a*, and an air chamber is formed in the upper region of the accommodating chamber 35*a*. The bypass tank 35 enlarges the flow path cross-sectional area of the bypass flow path 34 and may store a predetermined amount of fluid and air.

The opening/closing valve 37 openable to the atmosphere is connected to the air chamber of the bypass tank 35. That is, a connecting pipe 35*e* extending upward is provided on the upper wall of the bypass tank 35, and the opening/closing valve 37 that opens and closes the flow path in the connecting pipe 35*e* is provided at the other end of the connecting pipe 35*e*.

The circulation path 31, the bypass flow path 34, and the supply path 52 include a pipe made of a metal or a resin material, and a tube that covers the outer surface of the pipe, for example, a PTFE tube.

The pressure sensor 39 outputs pressure as an electric signal using a semiconductor piezoresistive pressure sensor, for example. The semiconductor piezoresistive pressure sensor includes a diaphragm that receives external pressure and a semiconductor strain gauge formed on the surface of the diaphragm. The semiconductor piezoresistive pressure sensor measures the pressure by converting the change in the electrical resistance caused by the piezoresistive effect generated in the strain gauge as the diaphragm deforms due to the pressure from the outside into an electric signal.

The fluid level sensors 54 and 55 are configured to include a float floating on the fluid surface and moving up and down and Hall ICs provided at two predetermined positions in the upper and lower portions. The fluid level sensors 54 and 55 measure the amount of fluid in the upstream tank 32 by measuring the float reaching an upper limit position and the lower limit position by the Hall ICs to send the measured data to the module control unit 38.

The opening/closing valve 37 is configured to open and close the air chamber of the bypass tank 35 with respect to the atmosphere. The opening/closing valve 37 is opened when the pressure sensor 39 connected to the bypass tank 35 is calibrated.

The circulation pump 33 is provided in the third flow path 31*c* of the circulation path 31. The circulation pump 33 is disposed between the downstream tank 36 and the upstream tank 32 and sends fluid from the downstream tank 36 to the upstream tank 32.

The replenishing pump 53 is provided in the supply path 52. The replenishing pump 53 sends the fluid in the cartridge 51 toward the upstream tank 32.

The circulation pump 33 and the replenishing pump 53 each include a piezoelectric pump 60 as shown in FIG. 6, for example. The piezoelectric pump 60 includes a pump chamber 58, a piezoelectric actuator 59 provided in the pump chamber 58 and vibrating by a voltage, and check valves 61 and 62 disposed at the inlet and outlet of the pump chamber 58. The piezoelectric actuator 59 is configured to vibrate at a frequency of, for example, about 50 Hz to 200 Hz. The circulation pump 33 and the replenishing pump 53 are connected to the drive circuit by wiring and are configured to be controllable under the control of the module control unit 38. When an AC voltage is applied to the piezoelectric pump 60 and the piezoelectric actuator 59 is operated, the volume of the pump chamber 58 changes. In the piezoelectric pump 60, when the applied voltage changes, the maximum change amount of the piezoelectric actuator 59 changes, and the volume change amount of the pump chamber 58 changes. Then, when the volume of the pump chamber 58 is deformed in a direction to increase, the check valve 61 at the inlet of the pump chamber 58 is opened and the fluid flows into the pump chamber 58. On the other hand, when the volume of the pump chamber 58 changes in a direction to decrease, the check valve 62 at the outlet of the pump chamber 58 opens and the fluid flows out from the pump chamber 58. The piezoelectric pump 60 repeats expansion and contraction of the pump chamber 58 to deliver the fluid to the downstream. Therefore, when the voltage applied to the piezoelectric actuator 59 is large, fluid delivery capability becomes strong, and when the voltage is small, the fluid delivery capability becomes weak. For example, in the first embodiment, the voltage applied to the piezoelectric actuator 59 is varied between 50 V and 150 V.

As shown in FIG. 7, the module control unit 38 includes a CPU 71, a drive circuit for driving each element, a storage unit 72 that stores various kinds of data, and a communication interface 73 for communication with an externally provided host control device (host computer) 13 on a control board integrally mounted on the circulation device 30. The storage unit 72 includes, for example, a program memory and a RAM.

The module control unit 38 communicates with the host control device 13 in a state of being connected to the host control device 13 through the communication interface 73, thereby receiving various information such as operation conditions and like.

An input operation by the user and an instruction from the host control device 13 of the inkjet recording apparatus 1 are transmitted to the CPU 71 of the module control unit 38 by the communication interface 73. Various information acquired by the module control unit 38 is sent to a PC application or the host control device 13 of the inkjet recording apparatus 1 via the communication interface 73.

The CPU 71 corresponds to the central part of the module control unit 38. The CPU 71 controls each unit to realize various functions of the fluid ejection apparatus according to the operating system and the application program.

The circulation pump 33, the replenishing pump 53, and the pressure adjustment mechanism 40 of the circulation device 30, drive circuits 75*a*, 75*b*, 75*c* and 75*d* of the opening/closing valve 37, the fluid level sensors 54 and 55, the pressure sensor 39, and a drive circuit 75*e* of the fluid ejection head 20 are connected to the CPU 71.

For example, the CPU 71 has a function as circulation means for circulating the fluid by controlling the operation of the circulation pump 33.

The CPU 71 has a function as replenishing means for supplying fluid from the cartridge 51 to the circulation path 31 by controlling the operation of the replenishing pump 53 based on the information measured by the fluid level sensors 54 and 55.

The CPU 71 has a function as pressure adjusting means for adjusting the pressure of the fluid in the nozzle 21*a* by controlling the pressure adjustment mechanism 40 based on the pressure values measured by the pressure sensor 39. As pressure adjustment processing, the CPU 71 adjusts the fluid pressure of the nozzle 21*a*, for example, by pressurizing or depressurizing the gas pressure of the downstream tank 36.

The storage unit 72 includes, for example, a program memory and a RAM. The storage unit 72 stores an application program and various setting values. In the storage unit 72, various setting values such as a calculation formula for calculating the fluid pressure of the nozzle 21*a*, a target pressure range, an adjustment maximum value of each pump, and the like are stored as control data used for pressure control, for example.

Figure 8:
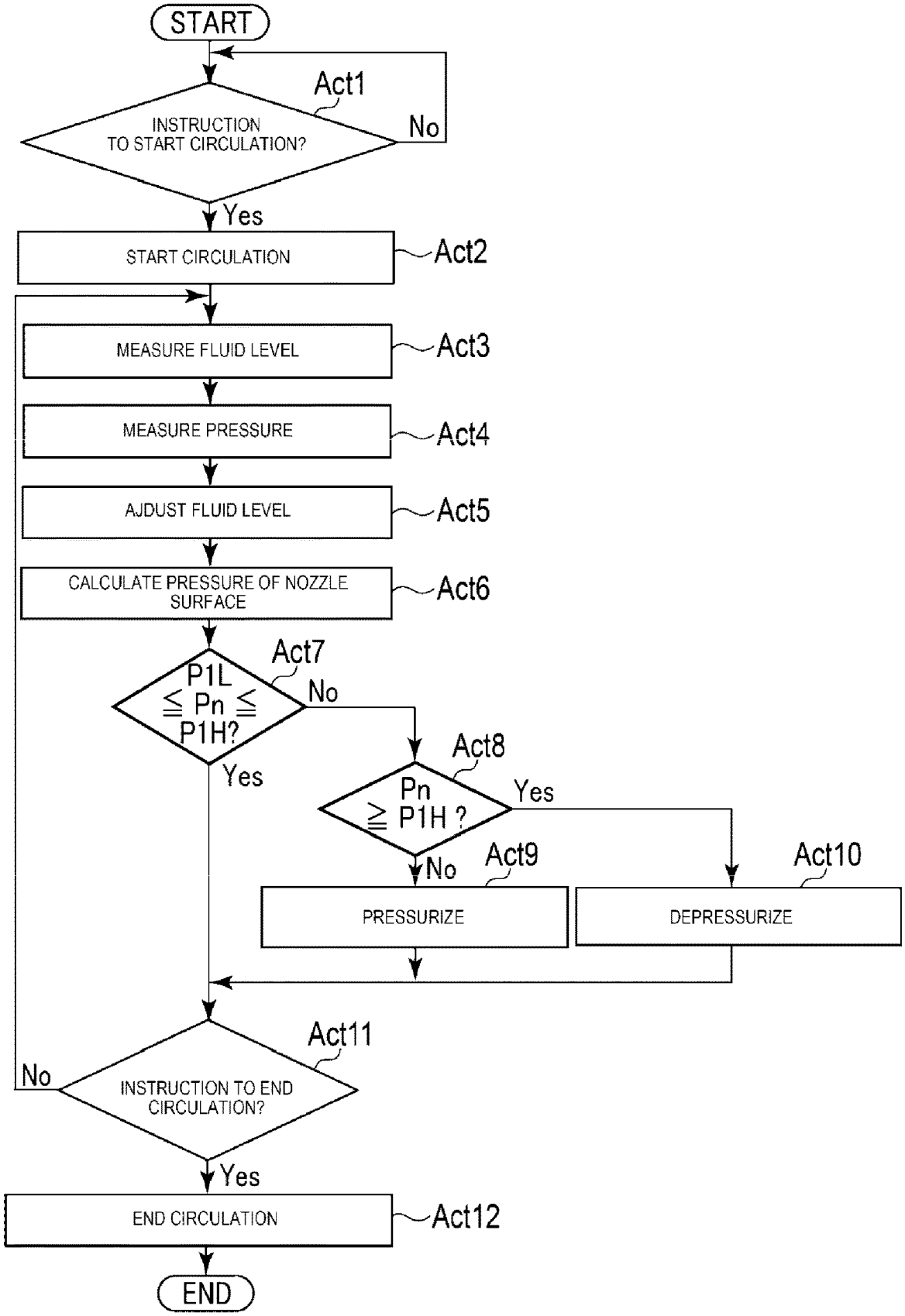
FIG. 8 is a flowchart showing a control method of the fluid ejection apparatus.

Hereinafter, a control method of the fluid ejection apparatus 10 according to the first embodiment will be described with reference to the flowchart of FIG. 8.

In Act 1, the CPU 71 waits for an instruction to start circulation. For example, when an instruction to start circulation is detected with a command from the host control device 13 (YES in Act 1), the processing proceeds to Act 2. As a printing operation, the host control device 13 forms an image on the recording medium S by performing a fluid ejecting operation while reciprocally moving the fluid ejection apparatus 10 in a direction orthogonal to the carrying direction of the recording medium S. Specifically, the CPU 71 carries a carriage 11*a* provided in the head support mechanism 11 in the direction of the recording medium S to reciprocally move in the direction of an arrow A. The CPU 71 sends the image signal corresponding to the image data to the drive circuit 75*e* of the fluid ejection head 20, selectively drives the actuator 24 of the fluid ejection head 20, and ejects droplets of fluid from the nozzle 21*a* to the recording medium S.

In Act 2, the CPU 71 drives the circulation pump 33 to start a fluid circulation operation. Here, the fluid in the first flow path 31*a* is distributed to the fluid flowing in the fluid ejection head 20 and the fluid flowing in the bypass tank 35 through the bypass flow path 34, according to the pipe resistance of the bypass flow path 34 and the bypass tank 35. That is, part of the fluid flows from the upstream tank 32 to the fluid ejection head 20 through the first flow path 31*a*, passes through the second flow path 31*b*, reaches the downstream tank 36, and flows into the upstream tank 32 again. The remaining part of the fluid passes through the bypass flow path 34 and the bypass tank 35 from the first flow path 31*a*, is sent to the second flow path 31*b* without passing through the fluid ejection head 20, passes through the downstream tank 36, and flows into the upstream tank 32 again. By this circulation operation, the impurities contained in the fluid are removed by the filter provided in the circulation path 31.

In Act 3, the CPU 71 measures the fluid levels of the upstream tank 32 and the downstream tank 36 based on the data transmitted from the fluid level sensors 54 and 55.

In Act 4, the CPU 71 measures the pressure data transmitted from the pressure sensor 39.

In Act 5, the CPU 71 starts fluid level adjustment. Specifically, the CPU 71 drives the replenishing pump 53 based on the measurement results of the fluid level sensors 54 and 55, thereby performing fluid replenishment from the cartridge 51 and adjusting the fluid level position to an appropriate range. For example, at the time of printing, the fluid is ejected from the nozzle 21*a*, the fluid amount of the upstream tank 32 or the downstream tank 36 instantaneously decreases, and when the fluid level is lowered, the fluid is replenished. When the fluid amount increases again and the output of the fluid level sensor 54 is inverted, the CPU 71 stops the replenishing pump 53.

In Act 6, the CPU 71 measures the fluid pressure of the nozzle from the pressure data. Specifically, the fluid pressure of the nozzle 21*a* is calculated by using a predetermined arithmetic expression based on the pressure data of the bypass tank 35 transmitted from the pressure sensor 39.

For example, since the pressure measured by the bypass tank 35 is an average value of a fluid pressure value Ph of the first flow path 31*a* and a fluid pressure value Pl of the second flow path 31*b*, it is possible to obtain a fluid pressure Pn of the nozzle 21*a* by adding a pressure $\rho gh$ generated due to the water head difference between the height of a pressure measurement point and the height of the nozzle surface to the pressure value of the bypass tank 35. Here, it is assumed that $\rho$ is the density of the ink, g is gravitational acceleration, and h is the distance between the pressure measurement point and the height direction of the nozzle surface.

As the pressure adjustment processing, the CPU 71 calculates the fluid pressure Pn of the nozzle 21*a* from the pressure data. Then, the CPU 71 maintains a negative pressure to an extent that the fluid does not leak from the nozzle 21*a* of the fluid ejection head 20 and bubbles are not sucked from the nozzle 21*a* and maintains a meniscus Me (FIG. 5) by driving the pressure adjustment mechanism 40 so that the fluid pressure Pn of the nozzle becomes an appropriate value. Here, as an example, it is assumed that the upper limit of a target value is P1H and the lower limit is P1L.

In Act 7, the CPU 71 determines whether the fluid pressure Pn of the nozzle is within an appropriate range, that is, whether $P1L \leq Pn \leq P1H$. If the fluid pressure Pn is out of the appropriate range (No in Act 7), the CPU 71 determines whether or not the fluid pressure Pn of the nozzle exceeds the upper limit of the target value P1H in Act 8.

More specifically, when the fluid pressure Pn of the nozzle is out of the appropriate range (No in Act 7) and the fluid pressure Pn of the nozzle does not exceed the upper limit of the target value P1H (No in Act 8), in Act 9, the CPU 71 drives the pressure adjustment mechanism 40 to pressurize the upstream tank 32 and the downstream tank 36, thereby pressurizing the fluid pressure of the nozzle 21*a* (Act 9).

In Act 8, when the fluid pressure Pn of the nozzle exceeds the upper limit of the target value P1H (yes in Act 8), the CPU 71 drives the pressure adjustment mechanism 40 to depressurize the upstream tank 32 and the downstream tank 36, thereby reducing the fluid pressure of the nozzle 21*a* (Act 10).

Thereafter, the CPU 71 performs feedback control of Acts 4 to 10 until a circulation end command is detected in Act 11. Then, when detecting an instruction to end the circulation with a command from the host control device 13 (Yes in Act 11), the CPU 71 stops the circulation pump 33 and ends the circulation processing (Act 12).

In the fluid ejection apparatus 10 configured as described above, the flow paths on the upstream side and the downstream side of the fluid ejection head 20 are connected by the bypass flow path 34, and the pressure sensor 39 is provided in the bypass tank 35 provided at a midpoint of the bypass flow path 34, thereby calculating the pressure of the fluid ejection head 20. Therefore, in the fluid ejection apparatus 10, the pressure sensor 39 may be provided in the flow path near the head, and the pressure sensor 39 on the circulation device 30 side may be omitted. It is possible to reduce the necessary number of the pressure sensors 39 and to simplify the apparatus configuration by calculating the average value on the upstream side and the downstream side of the fluid ejection head 20 with one pressure sensor 39.

In the fluid ejection apparatus 10, the flow paths on the upstream side and the downstream side of the fluid ejection head 20 are connected by the bypass flow path 34, and the fluid ejection apparatus 10 appropriately sets the pipe resistance of the bypass flow path 34, thereby appropriately maintaining the flow rate of the fluid passing through the fluid ejection head 20 and the fluid flowing through the bypass flow path 34.

The fluid ejection apparatus 10 may stabilize the ejection performance of the fluid ejection head 20 by connecting the flow paths on the upstream side and the downstream side of the fluid ejection head 20 with the bypass flow path 34 and providing the bypass tank 35. That is, by connecting the flow paths on the upstream side and the downstream side of the fluid ejection head 20 with the bypass flow path 34 and disposing the bypass tank 35 and the fluid ejection head 20 in parallel, due to the change in the flow path cross-sectional area between the bypass flow path 34 and the bypass tank 35 and the action of an air layer in the bypass tank 35 as an air spring, the pressure fluctuation in the bypass flow path 34 is absorbed and the pulsation is absorbed, thereby stabilizing the ejection performance.

For example, when the circulation path 31 becomes negative pressure due to a large amount of fluid ejection, the volume of the bypass tank 35 is reduced and the fluid level of the bypass tank 35 is lowered so that the pressure fluctuation on the circulation path 31 side may be absorbed.

The fluid ejection apparatus 10 may maintain the fluid pressure of the nozzle properly by measuring the pressure of the bypass flow path 34 of the fluid ejection head 20 and performing feedback control of the pressure. Therefore, even when the pump performance changes over time, it is possible to maintain appropriate pressure control.

Figure 9:
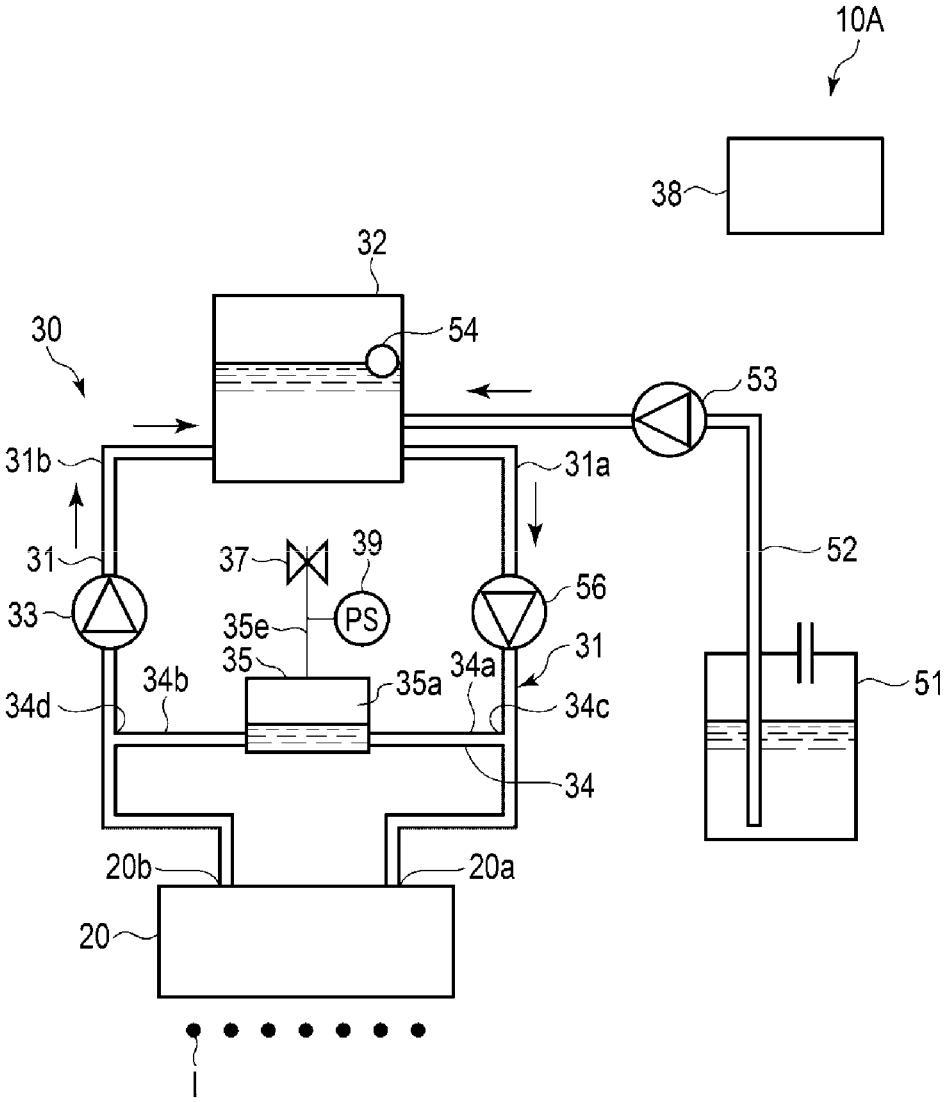
FIG. 9 is an explanatory view of a fluid ejection apparatus according to another embodiment.

The configurations of the fluid circulation apparatus and the fluid ejection apparatus according to the example embodiments described above are not limited. For example, in the example embodiments described above, the upstream tank 32 and the downstream tank 36 are provided in the first flow path 31*a* and the second flow path 31*b*. However, in some embodiments, the downstream tank 36 depicted in FIG. 2 may be omitted as in the fluid ejection apparatus 10A shown in FIG. 9 and the outflow side of the fluid ejection head 20 may be connected to the upstream tank 32. The fluid ejection apparatus 10A includes a circulation pump 33 in the second flow path 31*b* on the collection side and a circulation pump 56 as a third pump in the first flow path 31*a* on the supply side. For example, the circulation pump 56 has the same configuration as the circulation pump 33. The circulation pumps 33 and 56 become a depressurizing pump and a pressurizing pump, respectively and function as a pressure adjustment mechanism. The same effect as the fluid ejection apparatus 10 according to the first embodiment may be obtained also in the fluid ejection apparatus 10A.

The fluid ejection apparatus 10 may eject fluid other than ink. As a fluid ejection apparatus that ejects fluid other than ink, for example, an apparatus that ejects fluid containing conductive particles for forming a wiring pattern of a printed wiring board, or the like may be used.

In some embodiments, the fluid ejection head 20 may have a structure in which droplets of fluid are ejected by deforming the diaphragm with static electricity, a structure in which droplets of fluid are ejected from a nozzle using thermal energy of a heater, or the like.

In the example embodiments described above, the fluid ejection apparatus is used for the inkjet recording apparatus 1. However, the use of the fluid apparatus is not limited to this example. The fluid ejection apparatus may also be used, for example, in 3D printers, industrial manufacturing machines, and medical applications and may be reduced in size, weight, and cost.

As the circulation pump 33 and the replenishing pump 53, for example, a tube pump, a diaphragm pump, a piston pump or the like may be used instead of the piezoelectric pump 60.

While certain embodiments have been described, these embodiments have been presented by way of example only, and are not intended to limit the scope of the present disclosure. Indeed, the novel embodiments described herein may be embodied in a variety of other forms. Furthermore, various omissions, substitutions and changes in the form of the embodiments described herein may be made without departing from the spirit of the disclosure. The accompanying claims and their equivalents are intended to cover such forms or modifications as would fall within the scope and spirit of the present disclosure.

What is claimed is:

1. A fluid circulation apparatus, comprising:

a first tank to store fluid to be supplied to a fluid ejection head;

a circulation path including a first flow path portion to provide fluid from the first tank to a supply port of the fluid ejection head, and a second flow path portion to return fluid from a collection port of the fluid ejection head to the first tank;

a bypass flow path to connect the supply port to the collection port outside of the fluid ejection head;

a pressure sensor configured to measure pressure of the bypass flow path;

a bypass tank at the midpoint of the length of the bypass flow path; and an opening/closing valve connected to an air chamber of the bypass tank and configured to selectively open the air chamber to the atmosphere, wherein the pressure sensor measures pressure in the air chamber of the bypass tank.

2. The fluid circulation apparatus according to claim 1, further comprising:

a controller configured to adjust pressure of the circulation path based on the pressure of the bypass flow path as measured by the pressure sensor.

3. The fluid circulation apparatus according to claim 2, wherein the controller is configured to selectively open the first tank to adjust the pressure of the circulation path.

4. The fluid circulation apparatus according to claim 1, wherein the bypass flow path comprises a first bypass flow path portion fluidly connecting the first flow path portion to the bypass tank and a second bypass flow path portion fluidly connecting the bypass tank to the second flow path portion, and the first bypass flow path portion and the second bypass flow path portion are identical to each other in length and in a flow path cross-sectional area, which is less than a flow path cross-sectional area of the circulation path.

5. The fluid circulation apparatus according to claim 1, further comprising:

a circulation pump in the circulation path between the first tank and the fluid ejection head, the circulation pump being configured to send the fluid from the first tank toward the fluid ejection head; and a processor configured to adjust fluid output rates of the circulation pump based on pressure in the air chamber of the bypass tank as measured by the pressure sensor.

6. A fluid ejection apparatus, comprising:

a fluid ejection head having a nozzle;

a first tank to store fluid to be supplied to the fluid ejection head;

a second tank to store fluid collected from the fluid ejection head;

a circulation path including a first flow path portion to provide fluid from the first tank to a supply port of the fluid ejection head, a second flow path portion to return fluid from a collection port of the fluid ejection head to the second tank, and a third flow path portion fluidly connecting the second tank to the first tank;

a bypass flow path fluidly connecting the first flow path portion to the second flow path portion;

a pressure sensor configured to measure pressure of the bypass flow path;

a bypass tank in the bypass flow path; and an opening/closing valve connected to an air chamber of the bypass tank and configured to selectively open the air chamber to the atmosphere, wherein the pressure sensor measures pressure in the air chamber of the bypass tank.

7. The fluid ejection apparatus according to claim 6, further comprising:

a controller configured to adjust pressure of the circulation path based on the pressure of the bypass flow path as measured by the pressure sensor.

8. The fluid ejection apparatus according to claim 7, wherein the controller is configured to selectively open the first and second tanks to adjust the pressure of the circulation path.

9. The fluid ejection apparatus according to claim 6, wherein the bypass flow path comprises a first bypass flow path portion fluidly connecting the first flow path portion to the bypass tank and a second bypass flow path portion fluidly connecting the bypass tank to the second flow path portion, and the first bypass flow path portion and the second bypass flow path portion are identical to each other in length and in a flow path cross-sectional area, which is less than a flow path cross-sectional area of the circulation path.

10. The fluid ejection apparatus according to claim 6, further comprising:

a circulation pump in the circulation path between the first tank and the second tanks, the circulation pump being configured to send the fluid from the second tank toward the first tank; and a processor configured to adjust fluid output rates of the circulation pump based on pressure of the air chamber of the bypass tank as measured by the pressure sensor.

11. A fluid ejection apparatus, comprising:

a fluid ejection head having a nozzle;

a first tank to store fluid to be supplied to the fluid ejection head;

a circulation path including a first flow path portion to provide fluid from the first tank to a supply port of the fluid ejection head, and a second flow path portion to return fluid from a collection port of the fluid ejection head to the first tank;

a bypass flow path fluidly connecting the supply port to the collection port outside of the fluid ejection head and the circulation path;

a pressure sensor configured to measure pressure of the bypass flow path:

a bypass tank in the bypass flow path; and an opening/closing valve connected to an air chamber of the bypass tank and configured to selectively open the air chamber to the atmosphere, wherein the pressure sensor measures pressure in the air chamber of the bypass tank.

12. The fluid ejection apparatus according to claim 11, further comprising:

a controller configured to adjust pressure of the circulation path based on the pressure of the bypass flow path as measured by the pressure sensor.

13. The fluid ejection apparatus according to claim 12, wherein the controller is configured to selectively open the first tank to adjust the pressure of the circulation path.

14. The fluid ejection apparatus according to claim 11, wherein the bypass flow path comprises a first bypass flow path portion fluidly connecting the first flow path portion to the bypass tank and a second bypass flow path portion fluidly connecting the bypass tank to the second flow path portion, and the first bypass flow path portion and the second bypass flow path portion are identical to each other in length and in a flow path cross-sectional area, which is less than a flow path cross-sectional area of the circulation path.

* * * * *